United States Patent [19]

Alessio

[11] 4,202,140

[45] May 13, 1980

[54] ABRASIVE SHEET

[75] Inventor: Lorenzo E. Alessio, Cairoli, Italy

[73] Assignee: Black & Decker Inc., Newark, Del.

[21] Appl. No.: 945,374

[22] Filed: Sep. 25, 1978

[30] Foreign Application Priority Data

Sep. 23, 1977 [IT] Italy ..... 22348 A77

[51] Int. Cl.[2] ..... B24D 11/00

[52] U.S. Cl. ..... 51/395; 51/273

[58] Field of Search ..... 51/209 S, 273, 358, 51/394, 395, 398, 402, 407, DIG. 22, DIG. 34, 396, 397

[56] References Cited

U.S. PATENT DOCUMENTS

| | | | |
|---|---|---|---|
| 1,751,930 | 3/1930 | Legge | 51/209 S |
| 2,242,753 | 5/1941 | Milne | 51/209 S |
| 2,282,650 | 5/1942 | Fenton | 51/DIG. 22 |
| 2,499,933 | 3/1950 | Smul | 51/358 X |
| 3,353,308 | 11/1967 | Zane | 51/407 X |
| 3,609,925 | 10/1971 | Comella-Riera | 51/402 |
| 3,959,935 | 6/1976 | Stoppacher | 51/407 X |

FOREIGN PATENT DOCUMENTS

| | | | |
|---|---|---|---|
| 7601513 | 8/1976 | France | 51/394 |
| 506330 | 12/1956 | Italy | 51/209 S |
| 456985 | 11/1936 | United Kingdom . | |
| 868071 | 5/1961 | United Kingdom . | |

*Primary Examiner*—Gary L. Smith
*Assistant Examiner*—Robert P. Olszewski
*Attorney, Agent, or Firm*—Walter Ottesen; Leonard Bloom; Edward D. Murphy

[57] ABSTRACT

The invention is directed to an abrasive sheet for cutting a workpiece and is adapted for use with a sanding tool having a base plate with a plurality of apertures formed therein and equipped with a suction arrangement for establishing a partial vacuum at each of the apertures. The abrasive sheet includes a base sheet having a plurality of apertures formed therein and located thereon to register with the apertures of the base plate. An abrasive material is secured to the base sheet for defining a plurality of channels thereon which extend outwardly from each one of the apertures of the base sheet.

2 Claims, 2 Drawing Figures

ABRASIVE SHEET

BACKGROUND OF THE INVENTION

The invention is directed to an abrasive sheet for cutting a workpiece in a grinding or sanding operation. The abrasive sheet is adapted for use with a sanding tool such as a portable sander equipped with an apertured base plate. A suction arrangement of the sander develops a suction force for drawing sanding dust through the apertures and away from the surface of the workpiece.

The abrasive sheet is provided with apertures which register with the apertures of the base plate of the sander when the apertured abrasive sheet is mounted thereon. The motor of the tool imparts an orbital or reciprocating movement to the base plate and abrasive sheet. The suction arrangement develops a suction force for drawing dust produced during the abrading operation through the mutually aligned apertures in the abrasion sheet and base plate.

A disadvantage usually experienced with portable tools of the type described above is that a relevant amount of dust is produced during the sanding operation which tends to remain and become wedged between the particles of the abrasive material. This causes the abrasive material on the abrasive sheet to lose its cutting capability.

Accordingly, it is an object of my invention to obviate this disadvantage. More specifically, it is an object of my invention to provide an abrading sheet which will conduct and direct dust produced during the abrading operation to the apertures thereby preventing the dust from becoming lodged in the abrading material.

SUMMARY OF THE INVENTION

The abrasive sheet for cutting a workpiece according to my invention is adapted for use with a sanding tool having a suction arrangement for withdrawing the dust produced during the abrading operation away from the workpiece. The abrasive sheet according to my invention includes a base sheet having a plurality of apertures formed therein. Abrasive means is secured to the base sheet for defining a plurality of channels thereon extending outwardly from each one of the apertures.

The sanding tool develops a suction force at apertures in the base plate thereof to which the abrasive sheet is mounted. The dust produced by the sanding operation is then drawn through and along the channels formed on the abrasive sheet and directed to the apertures formed therein because of the suction force developed at the apertures by the suction arrangement associated with the sanding tool. The dust is drawn up through the apertures in the base plate and away from the surface of the workpiece. By conducting the dust away through these channels, the dust is prevented from wedging itself between the particles of the abrasive material thereby enabling the abrasive sheet to be effective in a uniform manner over whole surface abrasive sheet contacting the workpiece.

BRIEF DESCRIPTION OF THE DRAWING

The foregoing objects and advantages of my invention will become more apparent from a consideration of the detailed description to follow taken in conjunction with the drawing annexed hereto wherein.

DESCRIPTION OF THE PREFERRED EMBODIMENTS OF THE INVENTION

Figure 1:
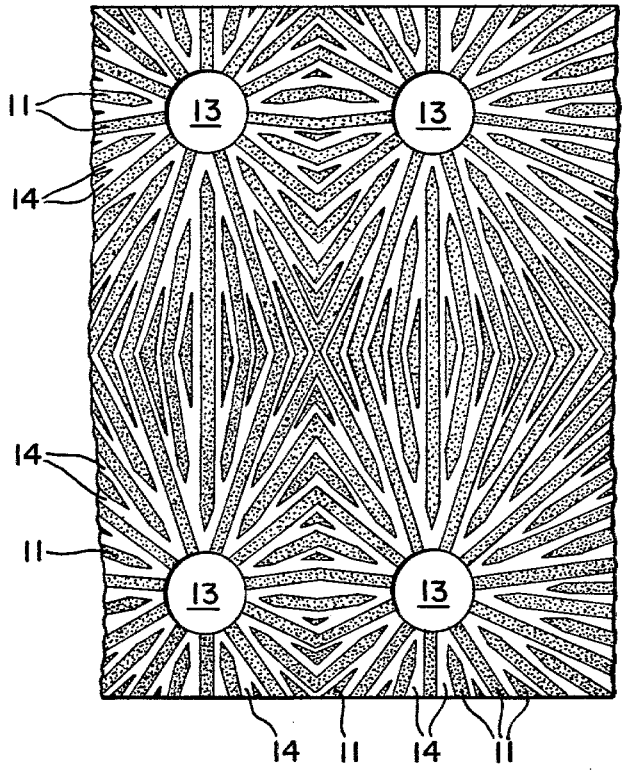
FIG. 1 is a plan view of the abrasive sheet according to my invention.
Figure 2:
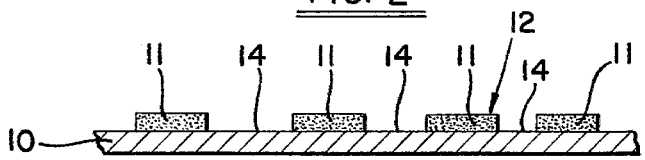
FIG. 2 is an exploded section view of a portion of the abrasive sheet of FIG. 1.

Referring now to the drawing, the abrasive sheet according to the invention includes the supporting sheet 10 which can for example be cloth, paper or some other suitable material. On one face of supporting sheet 10, particles 11 of a natural or artificial abrasive substance are applied with adhesive material.

The particles 11 are applied to the supporting sheet 10 so as to define mutually spaced substantially rectangular reliefs 12. The reliefs 12 conjointly define a plurality of channels 14 which converge to the apertures 13 formed in the supporting sheet 10. The spaces between the reliefs 12 form a labyrinth of exhaust channels 14 where channels which radially converge to one aperture communicate with channels which converge to the adjacent aperture.

The abrasive sheet is adapted for mounting to the apertured base plate of a portable grinding device such as a sander. The sander is preferably provided with suction means for developing a partial vacuum at the apertures for dust removal. The apertures in the abrasive sheet are located so that they register with corresponding ones of the apertures in the base plate. Thus, the apertures 13 are located in the abrasive sheet in accordance with the location of the apertures in the tool to which the abrasive sheet is mounted.

Accordingly, when utilizing the abrasive sheet of my invention, the dust produced during the sanding operation will be conducted along the exhaust channels 14 to the apertures 13 and through the corresponding apertures in the base plate of the sander by the suction power developed by the suction means of the sander. In this way, the invention prevents the dust from becoming wedged between the particles of abrasive material making up the grinding surface of the abrasive sheet. With the dust continuously conducted away from the grinding region along the channels, the abrading particles are free to penetrate and cut the surface of the workpiece.

The suction of dust away from the sanding region of abrasive sheet is facilitated by arranging the channels 14 so that they extend radially away from the apertures.

With abrasive sheet of the invention, the full grinding effect of the abrasive sheet as well as an extremely uniform sand-finish of the workpiece being worked are obtained.

The labyrinth of channels of course may have a different pattern than that shown in FIG. 1 without departing from the spirit of the invention.

What I claim is:

1. An abrasive sheet for cutting a workpiece adapted for use with a sanding tool having suction means, the abrasive sheet comprising:

a base sheet having a plurality of apertures formed therein; and, abrasive means secured to said base sheet for defining a plurality of channels thereon extending outwardly from each one of said apertures; and, said abrasive means defining a plurality of channels communicating with each two mutually adjacent ones of said apertures.

2. An abrasive sheet for cutting a workpiece adapted for use with a sanding tool having a base plate with a plurality of apertures formed therein and equipped suction means for establishing a partial vacuum at each of said apertures, the abrasive sheet comprising:

a base sheet having a plurality of apertures formed therein and located thereon to register with corresponding ones of the apertures of said base plate;

abrasive means secured to said base sheet for defining a plurality of channels thereon extending ouwardly from each one of said apertures of said base sheet; and, said abrasive means defining a plurality of channels communicating with each two mutually adjacent ones of said apertures.

* * * * *